US010220253B2

(12) United States Patent
Cox

(10) Patent No.: US 10,220,253 B2
(45) Date of Patent: Mar. 5, 2019

(54) EXERCISE APPARATUS

(71) Applicant: HEINZ KETTLER GMBH & CO. KG, Ense (DE)

(72) Inventor: Thomas Cox, Norwich (GB)

(73) Assignee: Heinz Kettler GmbH & Co. KG, Ense (DE)

( * ) Notice: Subject to any disclaimer, the term of this patent is extended or adjusted under 35 U.S.C. 154(b) by 139 days.

(21) Appl. No.: 15/115,818

(22) PCT Filed: Jan. 30, 2015

(86) PCT No.: PCT/GB2015/050257

§ 371 (c)(1),
(2) Date: Aug. 1, 2016

(87) PCT Pub. No.: WO2015/114377

PCT Pub. Date: Aug. 6, 2015

(65) Prior Publication Data

US 2017/0007878 A1 Jan. 12, 2017

(30) Foreign Application Priority Data

Jan. 31, 2014 (GB) ..... 1401668.7

(51) Int. Cl.
*A63B 21/00* (2006.01)
*A63B 21/04* (2006.01)
(Continued)

(52) U.S. Cl.
CPC ..... *A63B 23/1236* (2013.01); *A63B 21/0552* (2013.01); *A63B 21/068* (2013.01);
(Continued)

(58) Field of Classification Search
CPC ..... A63B 21/0004; A63B 21/00043; A63B 21/00058; A63B 21/00061; A63B 21/00065; A63B 21/00069; A63B 21/00072; A63B 21/00076; A63B 21/00185; A63B 21/002; A63B 21/0023; A63B 21/012; A63B 21/0125;
(Continued)

(56) References Cited

U.S. PATENT DOCUMENTS 7,585,262 B1 9/2009 Vayntraub
8,105,218 B1 1/2012 Vayntraub
(Continued)

FOREIGN PATENT DOCUMENTS

WO 2014022263 A1 2/2014

*Primary Examiner* — Gary D Urbiel Goldner
(74) *Attorney, Agent, or Firm* — Laurence A. Greenberg; Werner H. Stemer; Ralph E. Locher

(57) ABSTRACT

An exercise apparatus includes a pair of handle elements and a pair of housing elements. Each handle element includes a manually grippable bar and a base portion having a substantially spherical contact surface. Each housing element is substantially hemispherical and has a substantially central window. Each handle element is releasably locatable within a housing element to form a substantially hemispherical handle body in which the contact surface of the handle element is located within the window of the housing element and provides a contact point about which the housing body is rotatable when located on a support surface.

25 Claims, 23 Drawing Sheets

(51) Int. Cl.

| | |
|---|---|
| ***A63B 21/055*** | (2006.01) |
| ***A63B 21/068*** | (2006.01) |
| ***A63B 21/072*** | (2006.01) |
| ***A63B 22/00*** | (2006.01) |
| ***A63B 22/18*** | (2006.01) |
| ***A63B 23/02*** | (2006.01) |
| ***A63B 23/035*** | (2006.01) |
| ***A63B 23/12*** | (2006.01) |
| ***A63B 26/00*** | (2006.01) |
| ***A63B 71/00*** | (2006.01) |
| *A63B 71/02* | (2006.01) |

(52) U.S. Cl.
CPC ..... *A63B 21/4035* (2015.10); *A63B 21/4043* (2015.10); *A63B 22/0002* (2013.01); *A63B 22/18* (2013.01); *A63B 23/03541* (2013.01); *A63B 26/003* (2013.01); *A63B 21/0442* (2013.01); *A63B 21/0557* (2013.01); *A63B 21/072* (2013.01); *A63B 23/02* (2013.01); *A63B 23/1272* (2013.01); *A63B 2022/0092* (2013.01); *A63B 2071/0072* (2013.01); *A63B 2071/027* (2013.01); *A63B 2210/50* (2013.01)

(58) Field of Classification Search
CPC ..... A63B 21/02; A63B 21/04; A63B 21/0407; A63B 21/0414; A63B 21/0421; A63B 21/0428; A63B 21/0435; A63B 21/0442; A63B 21/055; A63B 21/0552; A63B 21/0555; A63B 21/0557; A63B 21/0615; A63B 21/0616; A63B 21/0617; A63B 21/065; A63B 21/068; A63B 21/072; A63B 21/0722; A63B 21/0724; A63B 21/078; A63B 21/08; A63B 21/15; A63B 21/151; A63B 21/159; A63B 21/4023; A63B 21/4027; A63B 21/4033; A63B 21/4035; A63B 21/4043; A63B 21/4047; A63B 21/4049; A63B 22/002; A63B 22/0005; A63B 22/0046; A63B 22/14; A63B 22/16; A63B 22/18; A63B 2022/0092; A63B 2022/185; A63B 23/02; A63B 23/0205; A63B 23/0211; A63B 23/0216; A63B 23/0222; A63B 23/035; A63B 23/03508; A63B 23/03516; A63B 23/03533; A63B 23/03541; A63B 23/12; A63B 23/1209; A63B 23/1227; A63B 23/1236; A63B 23/1245; A63B 23/1254; A63B 23/1253; A63B 23/1272; A63B 23/1281; A63B 26/00; A63B 26/003; A63B 69/0057; A63B 69/0059; A63B 71/0054; A63B 71/023; A63B 2071/0063; A63B 2071/0072; A63B 2071/009; A63B 2071/026; A63B 2071/027; A63B 2208/0295; A63B 2210/00; A63B 2210/50; A63B 2225/09; A63B 2225/093
See application file for complete search history.

(56) References Cited

U.S. PATENT DOCUMENTS

| | | | | |
|---|---|---|---|---|
| 8,382,647 | B1 * | 2/2013 | Hodes | A63B 21/072 482/108 |
| 8,814,768 | B1 * | 8/2014 | Yang | A63B 22/18 482/121 |
| 2011/0160024 | A1 * | 6/2011 | Candela | A63B 23/0211 482/132 |
| 2013/0137555 | A1 * | 5/2013 | Hodes | A63B 21/0726 482/106 |
| 2013/0190150 | A1 | 7/2013 | Delisle | |
| 2013/0316886 | A1 * | 11/2013 | Lynch | A63B 26/003 482/146 |
| 2014/0038795 | A1 | 2/2014 | Sassano et al. | |

* cited by examiner

CROSS-SECTIONAL SIDE VIEW

EXERCISE APPARATUS

BACKGROUND OF THE INVENTION

Field of the Invention

The present invention relates generally to exercise apparatus and particularly to exercise apparatus for allowing push-up exercise.

The push-up exercise is one of the most common out-of-gym exercises performed by those wanting to increase upper body strength. Though a simple, effective exercise, its technique encompasses ergonomic and physiological drawbacks that can lead to long term nerve and tissue damage in the hands and wrists; the identification of which has led to the production of push-up apparatus that supposedly addresses these issues.

BRIEF SUMMARY OF THE INVENTION

Whilst current solutions on the market claim to both increase ergonomic efficiency and enhance muscle interaction, research undertaken found this in fact to be only partially true. Whilst the incorporated rotating ability of modern apparatus go some way to improving the physiological flaws identified in the push-up technique, ultimately they are flawed due to the flat surface upon which they rotate.

Through the analysis of the evident popularity and effectiveness of both the barbell and dumbbell press gym-based exercises, and how various home gym products have tried to emulate these benefits but seemingly failed to do so, a solution was sought incorporating what is proven to be the most effective principle in free-weight integration—in addition to such popular gym equipment as the Swiss Ball—the principle of instability.

The present invention provides an exercise apparatus, comprising: a pair of handle elements, and a pair of housing elements; each handle element comprises a manually grippable bar and a base portion presenting a substantially spherical contact surface, each housing element is substantially hemispherical and defines a substantially central window, and each handle element is releasably locatable within a housing element to form a substantially hemispherical handle body in which the contact surface of the handle element is presented within the window of the housing element and provides a contact point about which the housing body is rotatable when located on a support surface.

The formed handle bodies may be releasably joinable to form a substantially spherical housing.

The handle bodies may be releasably joinable by an integrated clip arrangement.

The windows of said housing elements may present a ridge profile arranged to inhibit overtilting of the formed handle body to accommodate flexion, extension, radial and ulnar hand movements. The ridge profile may be arranged to inhibit overtilting of the handle body in either direction of rotation about the roll axis of the manually grippable bar. The ridge profile may be arranged to inhibit tilting of the formed handle body beyond approximately 30 degrees of rotation in either direction about the roll axis of the manually grippable bar, from the untilted position of the handle body.

The manually grippable bars may comprise securing means to allow a resistance band to be connected between them.

The manually grippable bars may be apertured to allow the end of a resistance band to be looped therethrough.

The apparatus may further comprise a resistance band containable within said substantially spherical housing.

The manually grippable bar may be positioned below the upper edge of the substantially hemispherical handle body.

The present invention also provides exercise apparatus comprising a pair of substantially hemispherical handle bodies, each handle body comprises a manually grippable bar, each handle body defines a substantially central window, in which a substantially spherical contact surface is presented that provides a contact point about which said handle body is rotatable when located on a support surface, and each handle body comprises a ridge profile for preventing overtilting in a direction of rotation about said contact point.

The handle bodies may be releasably joinable to form a substantially spherical housing.

The handle bodies may be releasably joinable by an integrated clip arrangement.

The ridge profile may be arranged to inhibit overtilting of the handle body in either direction of rotation about the roll axis of the manually grippable bar.

The ridge profile may be arranged to inhibit tilting of the handle body beyond approximately 30 degrees of rotation in either direction about the roll axis of the manually grippable bar, from the untilted position of the handle body.

The manually grippable bars may extend diametrically between opposed inner surfaces of the substantially hemispherical bodies.

The manually grippable bars may be removable from said substantially hemispherical bodies, and comprise securing means to allow a resistance band to be connected between the removed manually grippable bars.

The manually grippable bars may be apertured to allow the end of a resistance band to be looped through.

The apparatus may further comprise a resistance band containable within said substantially spherical housing.

The window may be formed integrally with the handle body.

Each handle body may be formed as a one-piece construction.

The present invention also provides push-up apparatus comprising or including the exercise apparatus as described herein.

The present invention also provides an exercise kit comprising exercise apparatus as described herein together with a resistance band.

Different aspects and embodiments of the invention may be used separately or together.

Further particular and preferred aspects of the present invention are set out in the accompanying independent and dependent claims. Features of the dependent claims may be combined with the features of the independent claims as appropriate, and in combination other than those explicitly set out in the claims.

BRIEF DESCRIPTION OF THE SEVERAL VIEWS OF THE DRAWING

The present invention will now be more particularly described, by way of example only, with reference to the accompanying drawings, in which.

DESCRIPTION OF THE INVENTION

Figure 1:
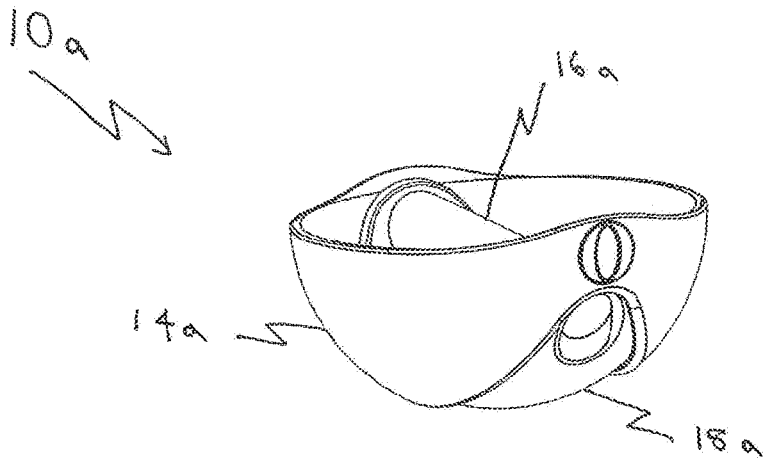
FIG. 1 is an isometric view of one of a pair of hemispherical push-up devices formed in accordance with the present invention.
Figure 2:
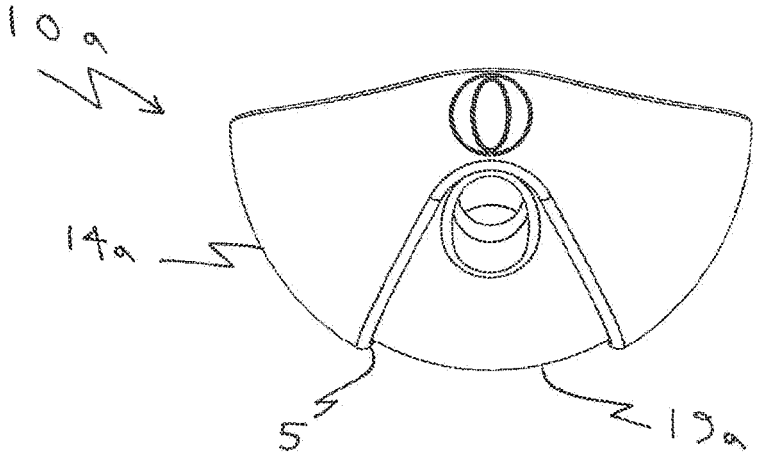
FIG. 2 is a front view of the device of FIG. 1.
Figure 3:
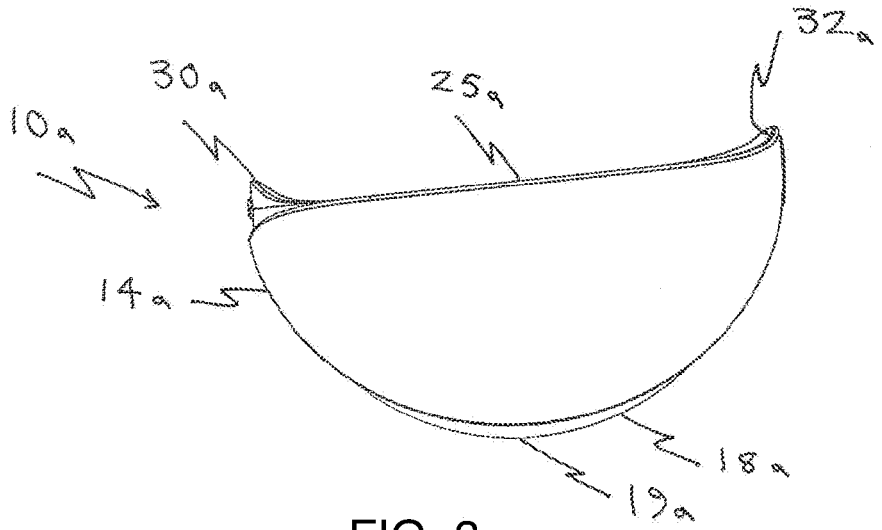
FIG. 3 is a side view of the device of FIG. 1.
Figure 4:
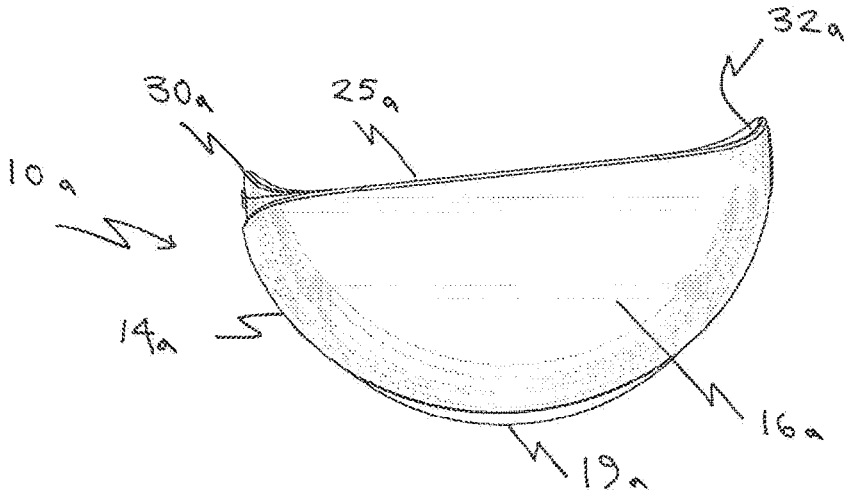
FIG. 4 is a further side view of the device of FIG. 1.
Figure 5:
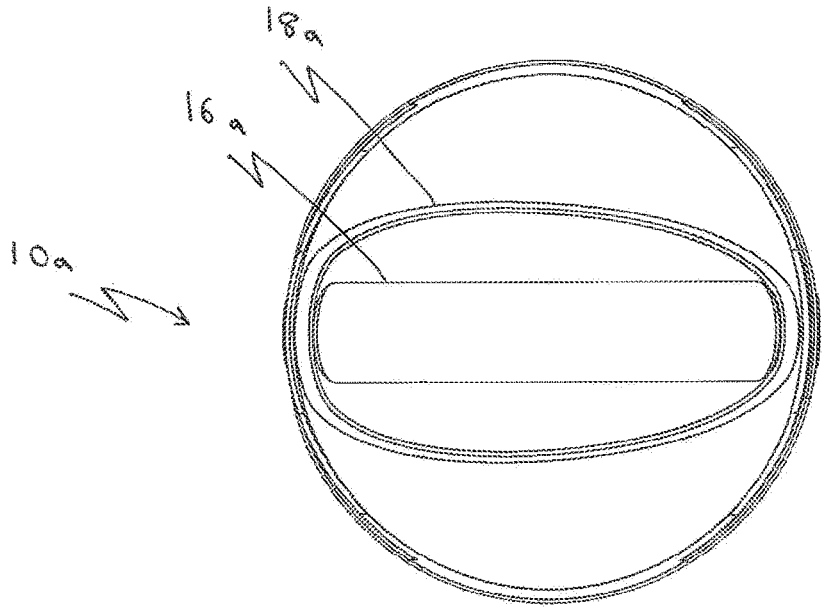
FIG. 5 is a top view of the device of FIG. 1.
Figure 6:
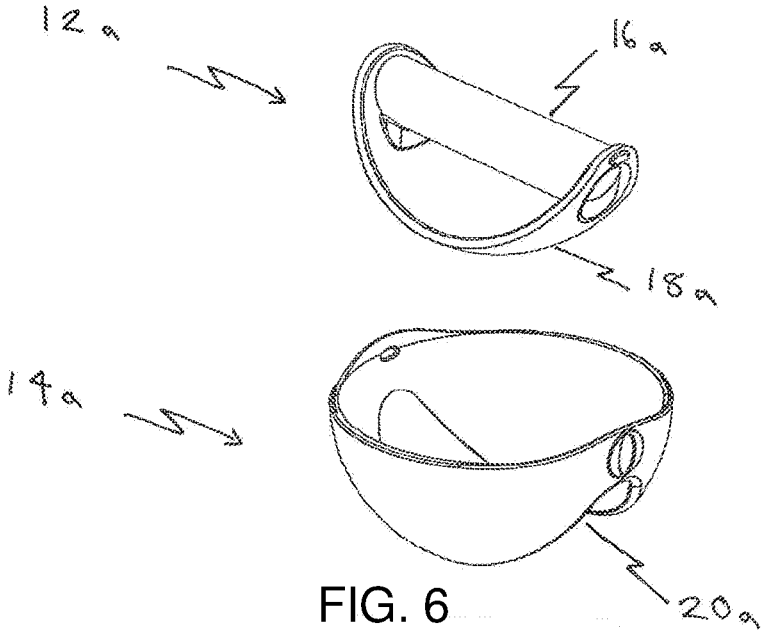
FIG. 6 is a perspective view of the device of FIG. 1 shown with a handle part removed from a body part and ready to use with a resistance band.

Example embodiments are described below in sufficient detail to enable those of ordinary skill in the art to embody and implement the systems and processes herein described. It is important to understand that embodiments can be provided in many alternate forms and should not be construed as limited to the examples set forth herein.

Accordingly, while embodiments can be modified in various ways and take on various alternative forms, specific embodiments thereof are shown in the drawings and described in detail below as examples. There is no intent to limit to the particular forms disclosed. On the contrary, all modifications, equivalents, and alternatives falling within the scope of the appended claims should be included. Elements of the example embodiments are consistently denoted by the same reference numerals throughout the drawings and detailed description where appropriate.

The terminology used herein to describe embodiments is not intended to limit the scope. The articles "a," "an," and "the" are singular in that they have a single referent, however the use of the singular form in the present document should not preclude the presence of more than one referent. In other words, elements referred to in the singular can number one or more, unless the context clearly indicates otherwise. It will be further understood that the terms "comprises," "comprising," "includes," and/or "including," when used herein, specify the presence of stated features, items, steps, operations, elements, and/or components, but do not preclude the presence or addition of one or more other features, items, steps, operations, elements, components, and/or groups thereof.

Unless otherwise defined, all terms (including technical and scientific terms) used herein are to be interpreted as is customary in the art. It will be further understood that terms in common usage should also be interpreted as is customary in the relevant art and not in an idealized or overly formal sense unless expressly so defined herein.

The apparatus incorporates an innovative set of mobile, multi-functional push-up apparatus that aims to increase ergonomic efficiency and enhances both upper body and core muscle interaction, eliminating all physiological drawbacks of the technique to provide the most effective push-up performance.

The spherical profile of each of a pair of hemispheres provides the apparatus with its effective unstable nature—increasing muscle interaction, whilst also enabling it to conform to the joint movements of the arms and hands—reducing strain, providing the most effective and ergonomic push-up solution.

In one embodiment [FIGS. 1 to 13] the apparatus comprises a pair of substantially identical generally hemispherical push-up shells 10*a*, 10*b*.

In FIGS. 1 to 7 one shell 10*a* is shown for clarity.

The shell 10*a* comprises a handle element 12*a* and a housing element 14*a*. Each handle element 12*a* comprises a manually grippable bar 16*a* and a base portion 18*a* presenting a substantially spherical contact surface 19*a*.

The housing element 14*a* is substantially hemispherical and defines a substantially central window 20*a*. The handle element 12*a* is releasably locatable within the housing element 14*a* to form a substantially hemispherical handle body in which the contact surface 19*a* of the handle element 12*a* is presented within the window 20*a* of the housing element and provides a contact point about which the housing body is rotatable when located on a support surface.

Figure 7:
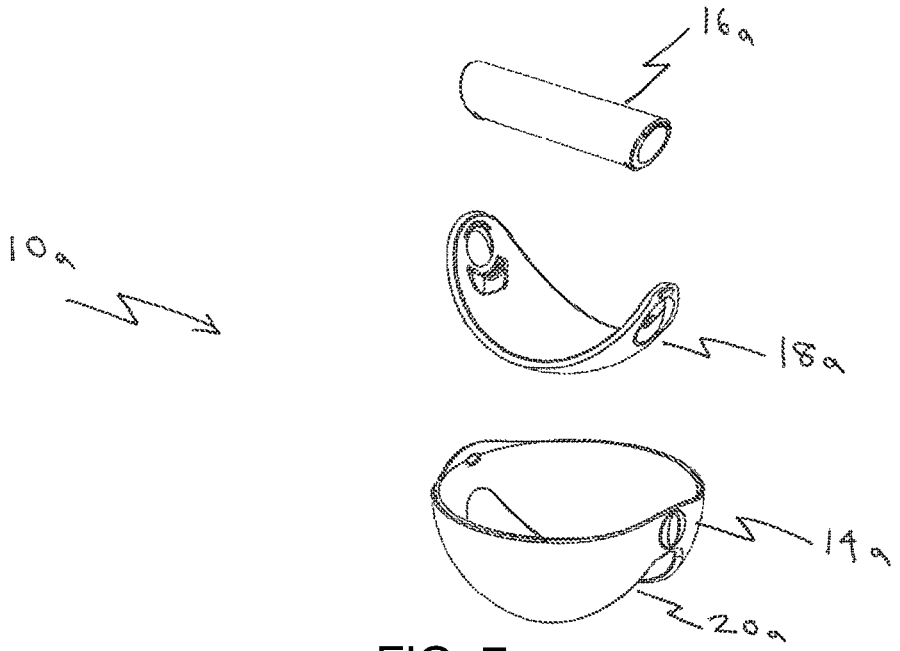
FIG. 7 shows the view of FIG. 6 with a handle bar removed from a handle part and showing how the hemisphere is constructed.
Figure 8:
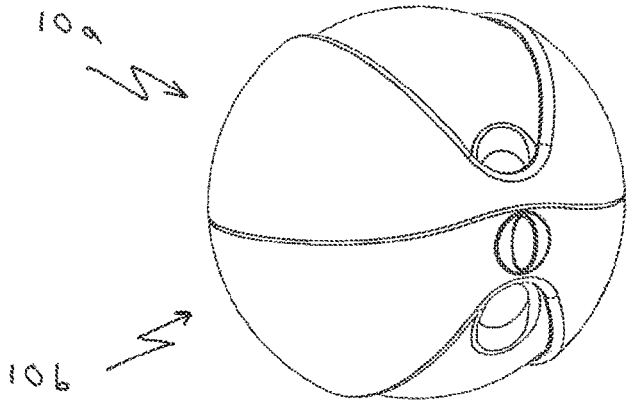
FIG. 8 is a perspective view of a pair of devices connected together to form a spherical body.
Figure 9:
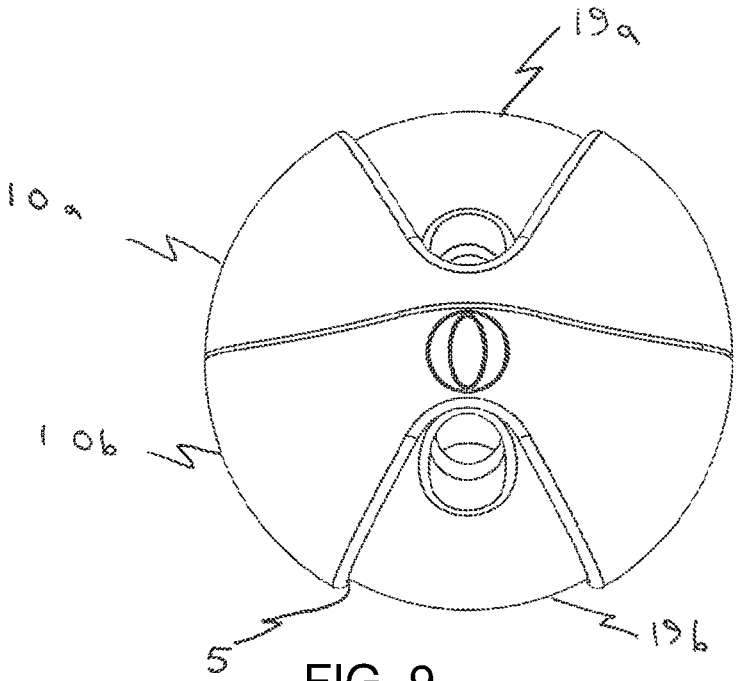
FIG. 9 is a front view of the spherical body of FIG. 8.
Figure 10:
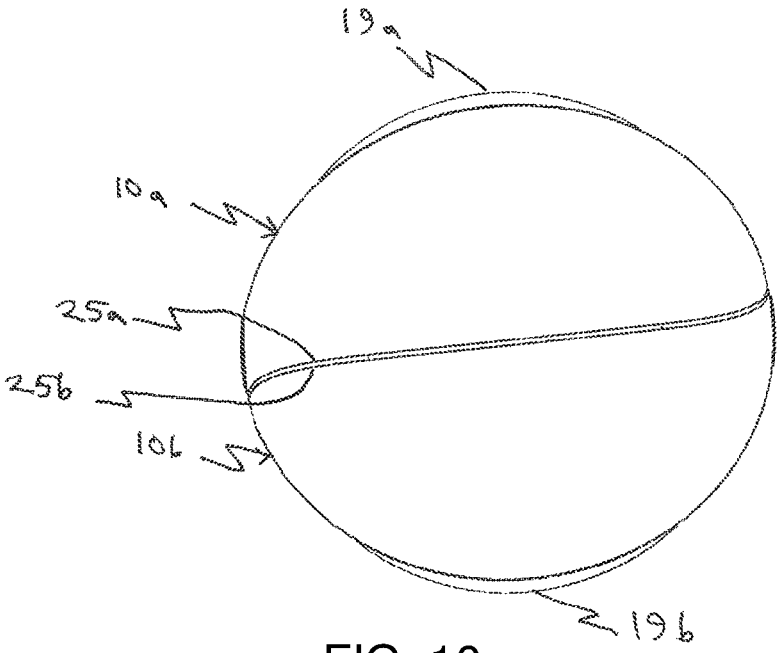
FIG. 10 is a side view of the spherical body of FIG. 8.
Figure 11:
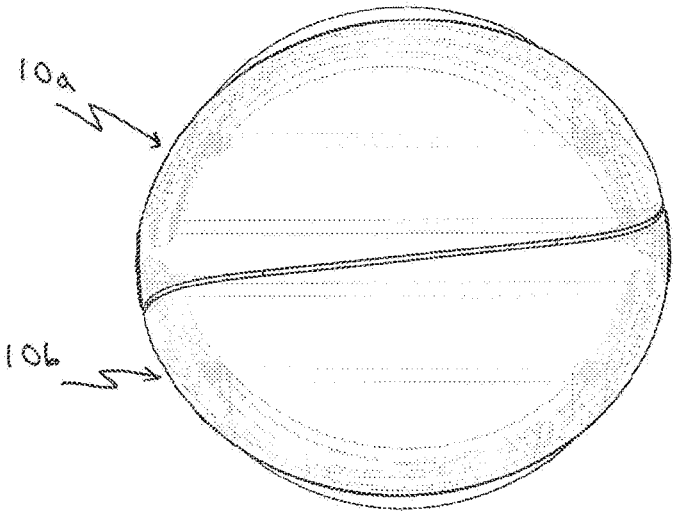
FIG. 11 is a further side view of the spherical body of FIG. 8.
Figure 12:
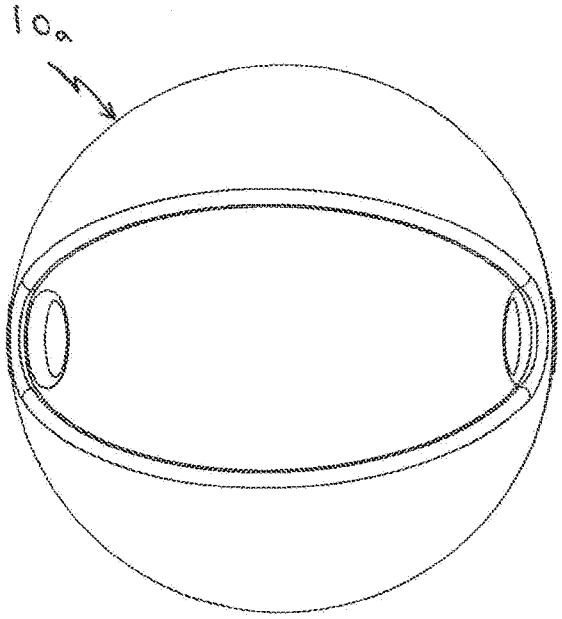
FIG. 12 is a top view of the spherical body of FIG. 8.
Figure 13:
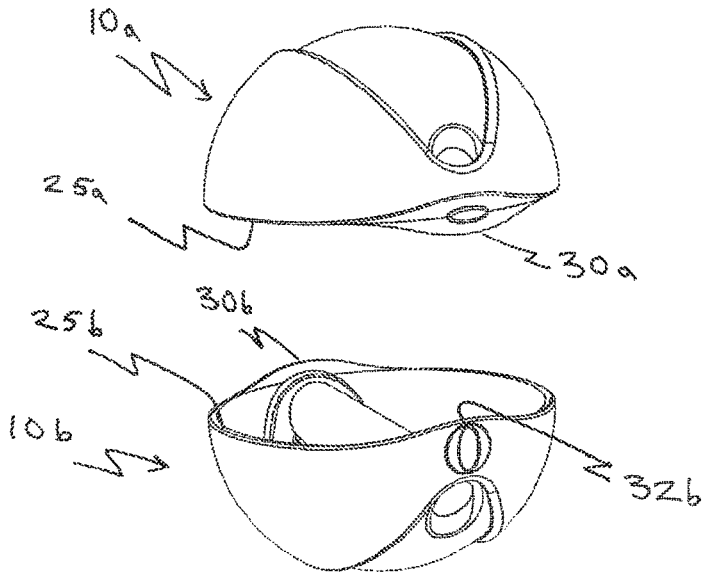
FIG. 13 is a perspective view of the spherical body of FIG. 8 as the two hemispheres separate ready for use.

In this embodiment the handle element 12*a* is formed from two parts: a generally cylindrical hollow bar 16*a* and a base portion in the form of a curved seat 18*a* [see FIG. 7]. The bar 16*a* connects into the seat 18*a* and the handle element 12*a* then fits into the housing 14*a* so that the seat 18*a* is presented in the window and serves as a bearing surface in push-up mode.

Figure 23:
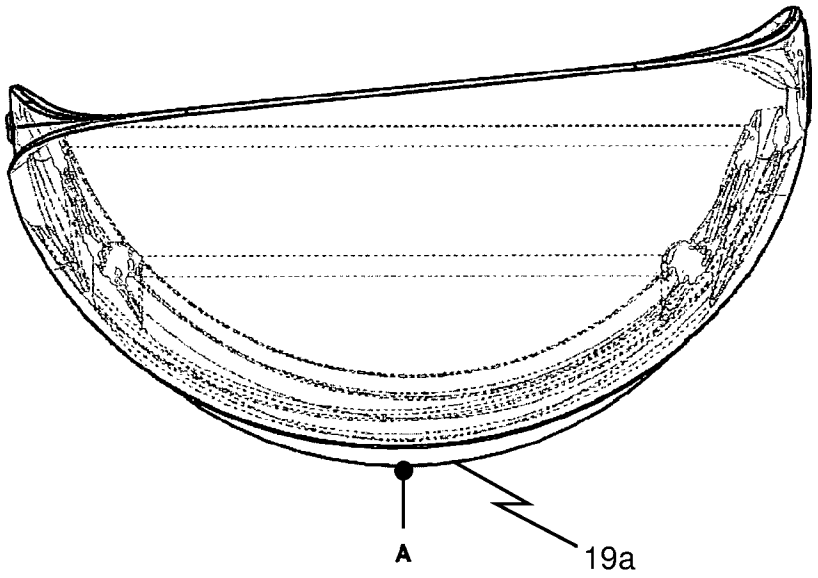

The point surface contact enables natural rotation, to accommodate pronation and supination arm movements. [FIG. 23]

It is to be noted that in this embodiment each handle body comprises a ridge profile 5 for preventing overtilting in a direction of rotation about the contact point. This is provided by the intersection between the periphery of the housing window and the contact surface (which is recessed in the window). The periphery of the housing window presents a ridge profile that prevents overtiliting.

Whilst the main purpose of the apparatus is as a set of advanced push-up apparatus, the product also doubles-up as a set of resistance tube handles. This versatile aspect transforms the product from a predominantly chest and core-region focused apparatus into a full-body workout set of apparatus. [FIGS. 16 and 17]

Integrated clip features enable each hemisphere to come together to form one compact, enclosed sphere I—enabling all five incorporated components to become one—within seconds. The peripheral rim of each hemisphere may be non-linear. For example, as shown in the figures the rim of a hemispherical portion of the exercise apparatus is undulating whilst the other hemisphere is correspondingly undulating to allow their connection to form a sphere. That is, as shown in FIGS. 8-12, 20-21, 25, 28 and 29 for example, an exercise apparatus in a closed configuration forms a sphere. Respective hemispheres of the apparatus have a peripheral rim profile 25*a*, 25*b* that is curved and configured to cooperate with the peripheral rim profile of one another to enable the portions to be brought together to form a spherical object in a closed configuration of the apparatus.

With reference to, for example, FIGS. 1-4, and 9-13, it can be seen that respective hemispherical portions can be arranged so that a respective tongues 30*a*, 30*b* cooperates with a respective recess 32*b*, 32*a* when the two parts are brought together. Accordingly, a peripheral outer rim portion of one hemispherical portion engages with a corresponding outer peripheral rim portion 401 of the other hemispherical portion whilst the tongues sit within recesses.

Alternatively, the peripheral rim of respective hemispherical portions of the apparatus can be linear such that there are no undulations.

In a closed configuration, the apparatus may be opened by a user by pulling apart to release the clips or by twisting the hemispherical portions so as to release the two parts from one another. In an example, such as if the peripheral rim of the portions of the apparatus is linear, the parts may be releasably connected by way of a screw thread, in which one portion has, for example, continuous or semi-continuous helical outer thread surface arranged to cooperate and engage with an inner surface of the other portion of the apparatus.

It is noted that the handle bar 16*a* is located within the hemisphere i.e. it does not project above the open side of the housing 14*a*. Having the handle bar close to the ground has been found by the present inventor to be important is allowing for an efficient push-up movement; providing instability but not excessively so.

Figure 14:
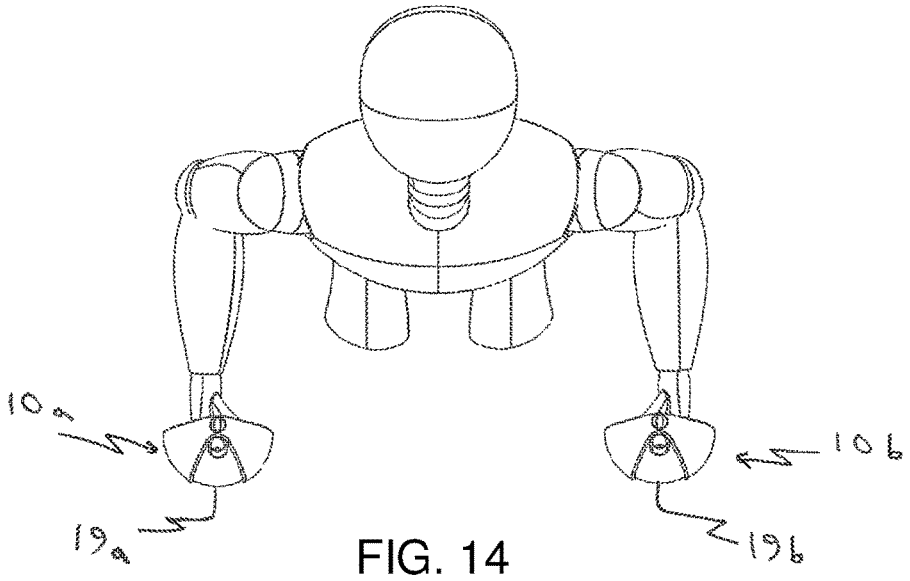
FIG. 14 is a front view illustrating the push-up stands in use.
Figure 15:
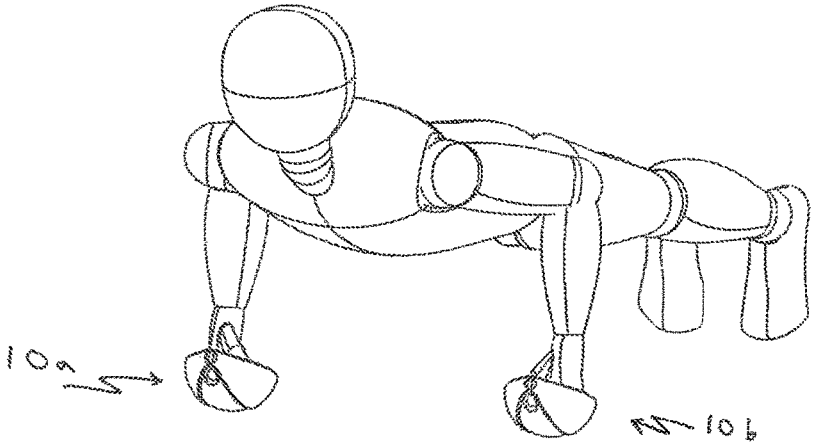
FIG. 15 is a perspective view of FIG. 14.

In FIGS. 14 and 15 the two shells 10*a*, 10*b* are shown in use, with the seats 19*a*, 19*b* in contact with the ground.

Figure 16:
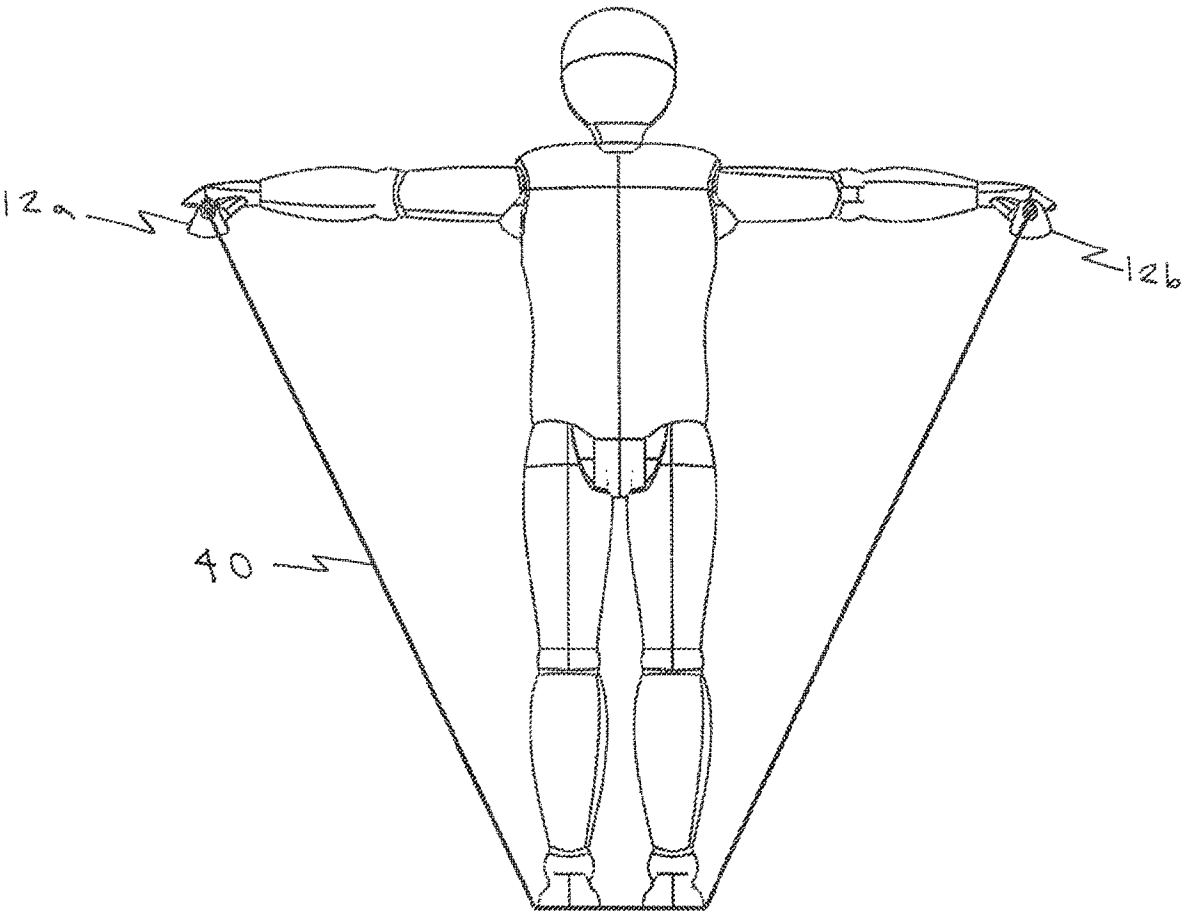
FIG. 16 is a front view illustrating the push-up handles with a housing removed and being utilised with a resistance band.
Figure 17:
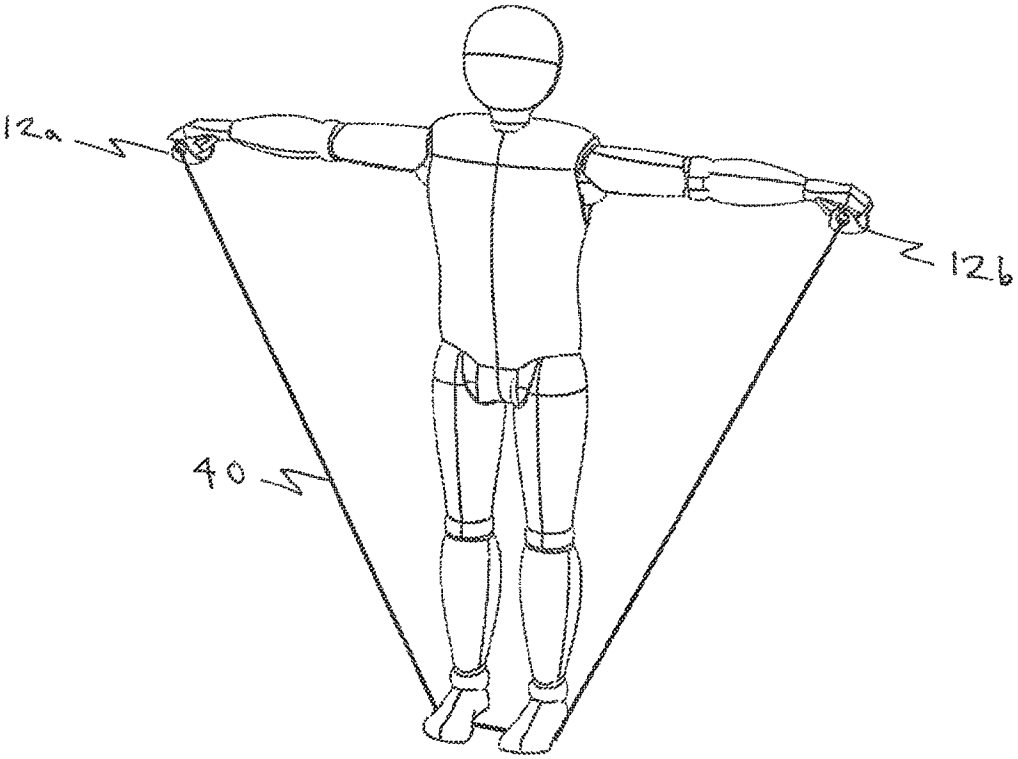
FIG. 17 is a perspective view of FIG. 16.
Figure 18:
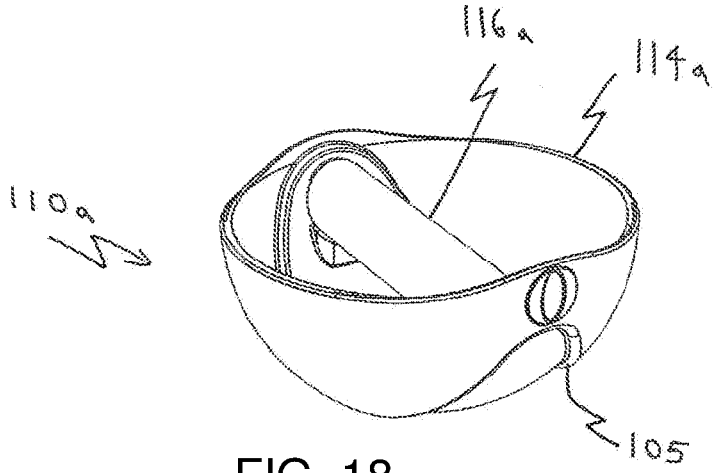
FIG. 18 is a perspective view of a hemispherical push-up stand formed according to an alternative embodiment.
Figure 19:
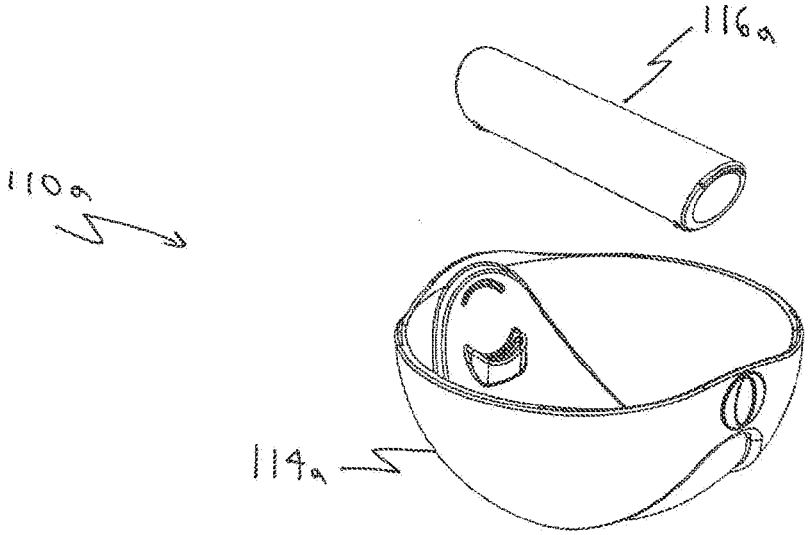
FIG. 19 shows the stand of FIG. 18 with a handle bar removed and thus ready to be used with a resistance band.
Figure 20:
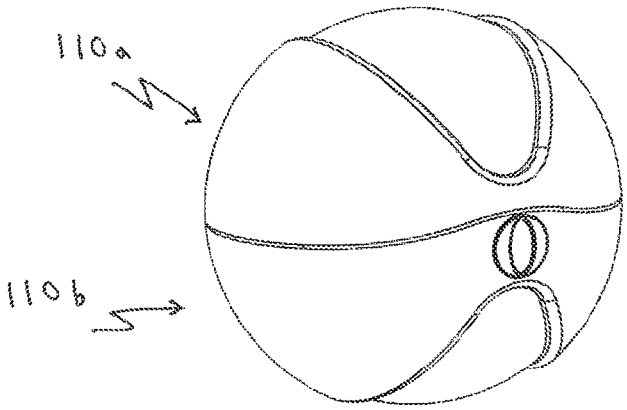
FIG. 20 is a perspective view showing two stands of the type shown in FIG. 18 connected together to form a sphere.
Figure 21:
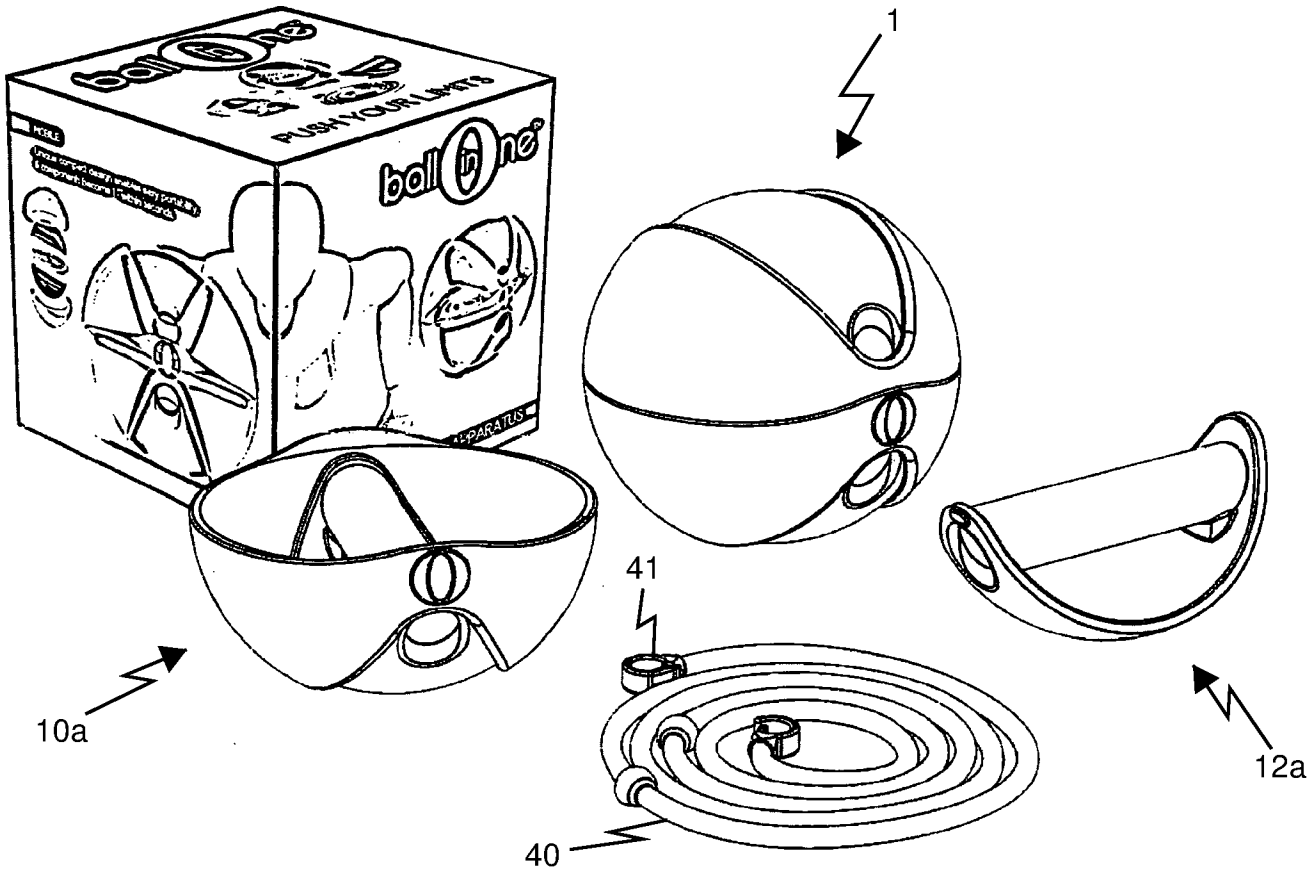
FIGS. 21 to 29 are a presentation illustrating the parts of usage of apparatus formed in accordance with the present invention.
Figure 22:
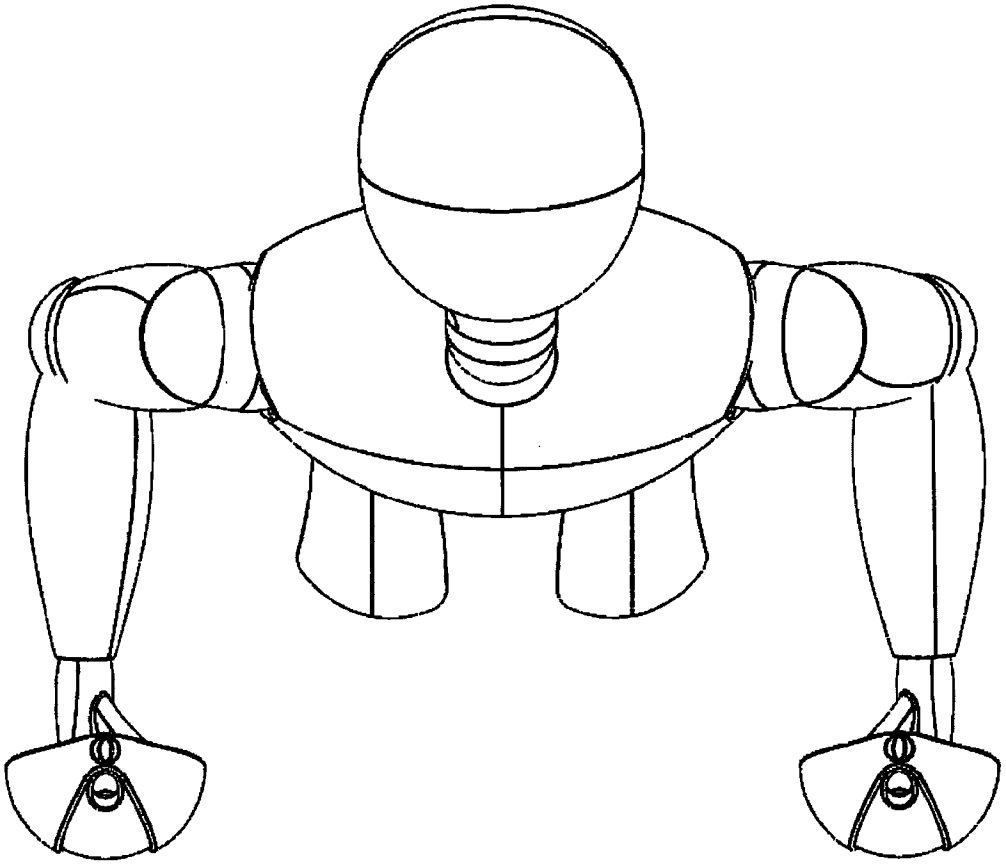
Figure 24:
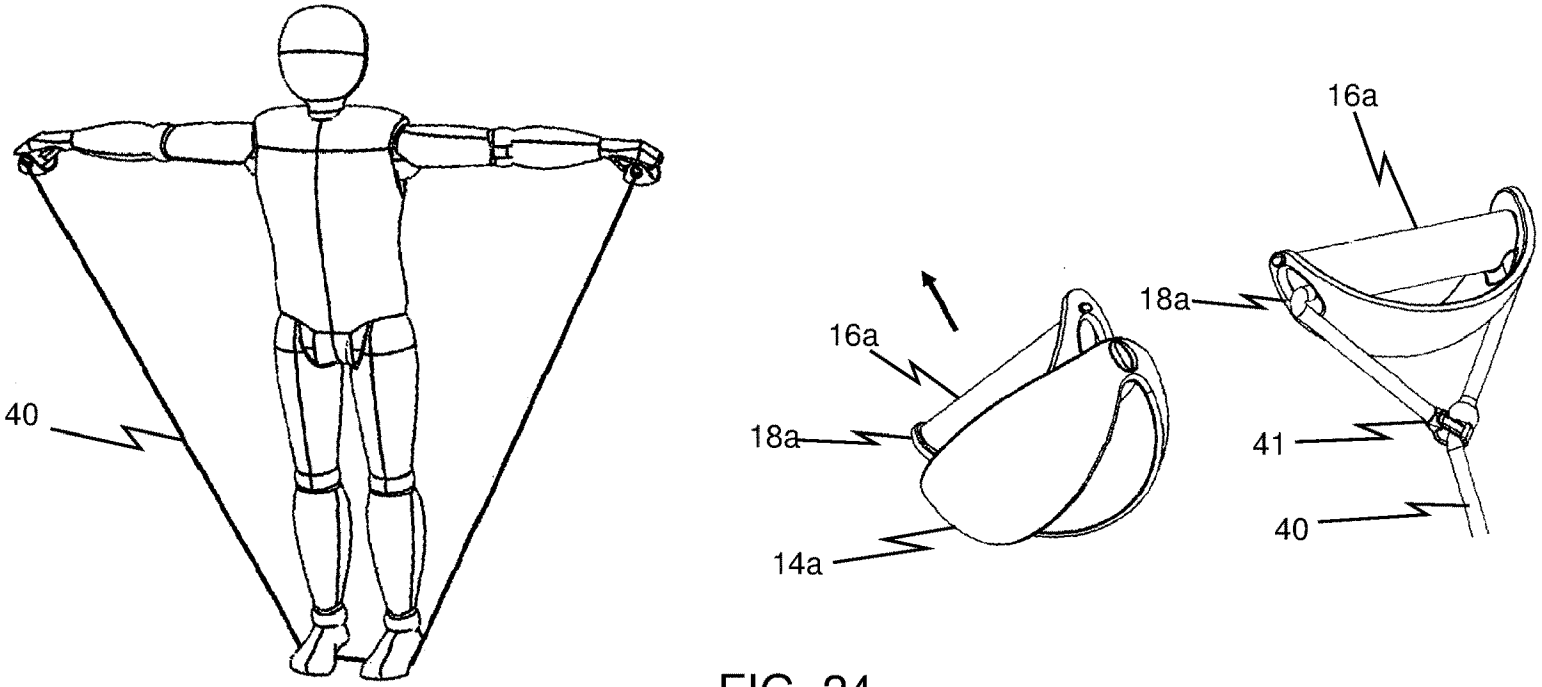
Figure 25:
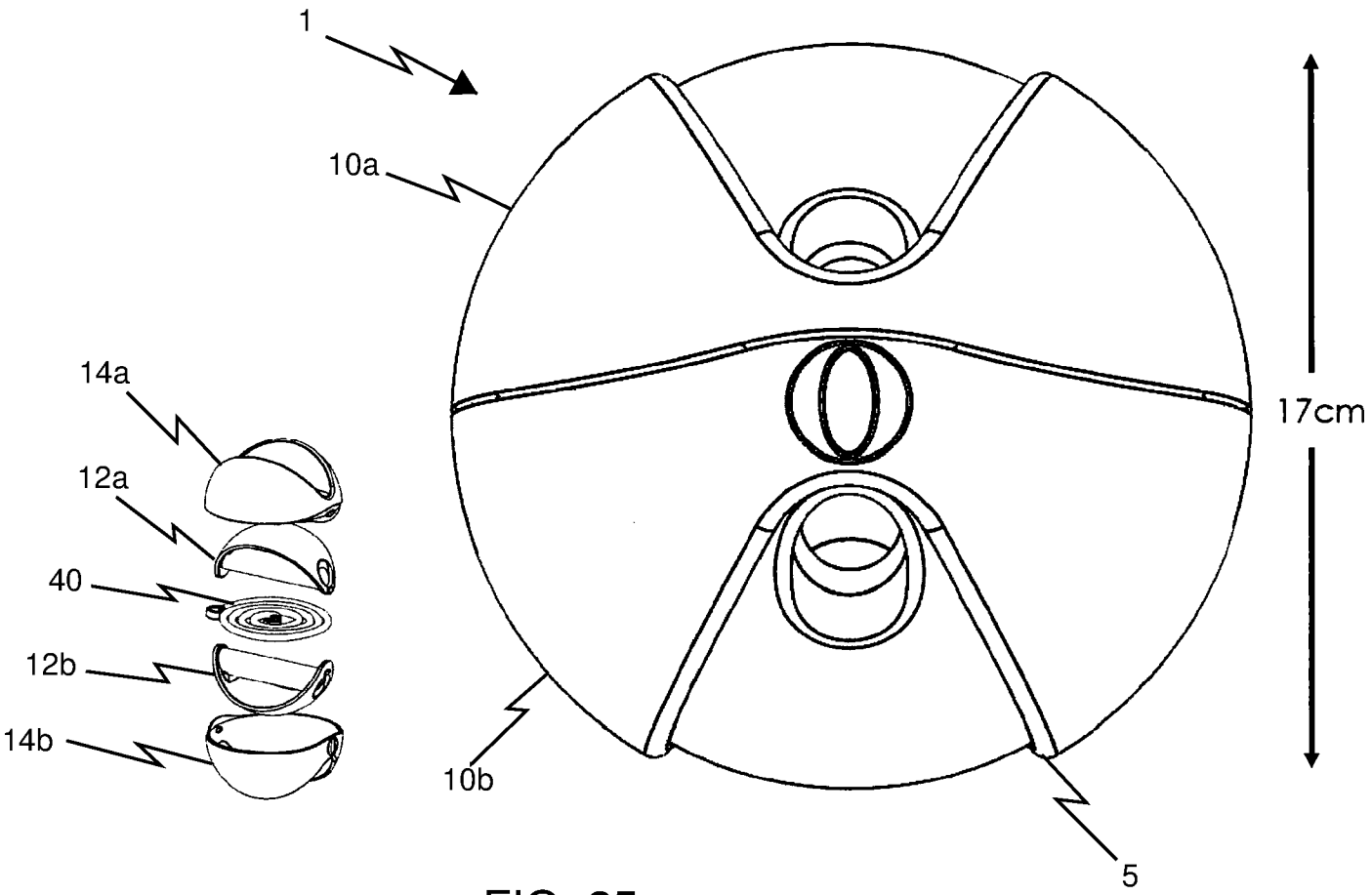
Figure 26:
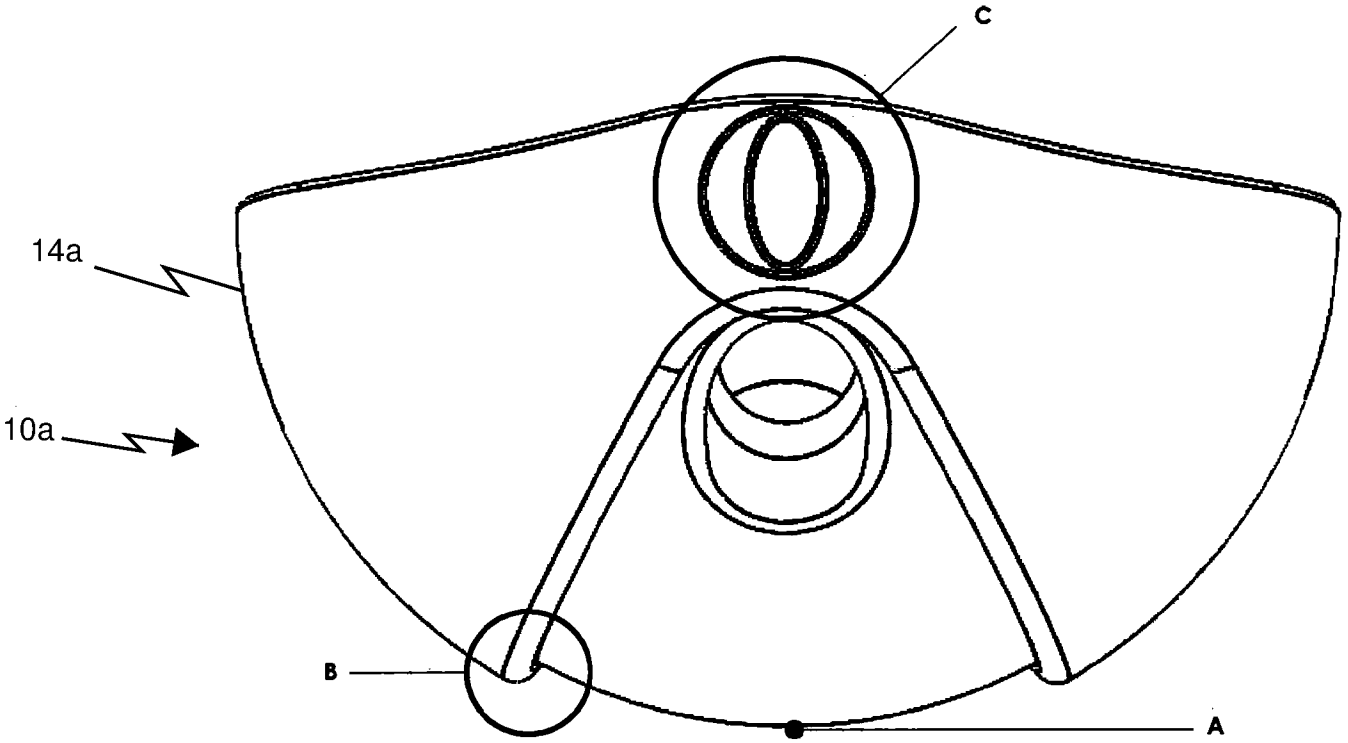
Figure 27:
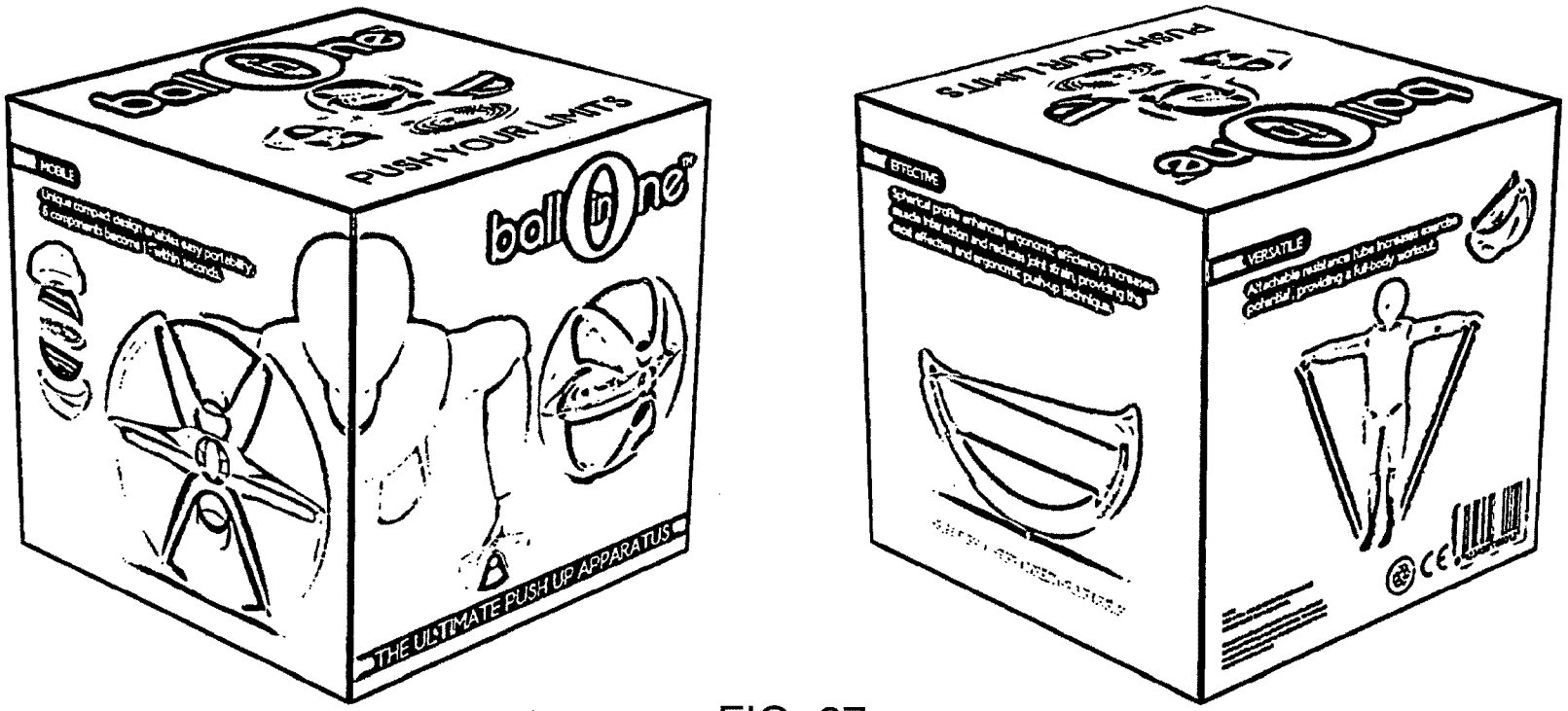
Figure 28:
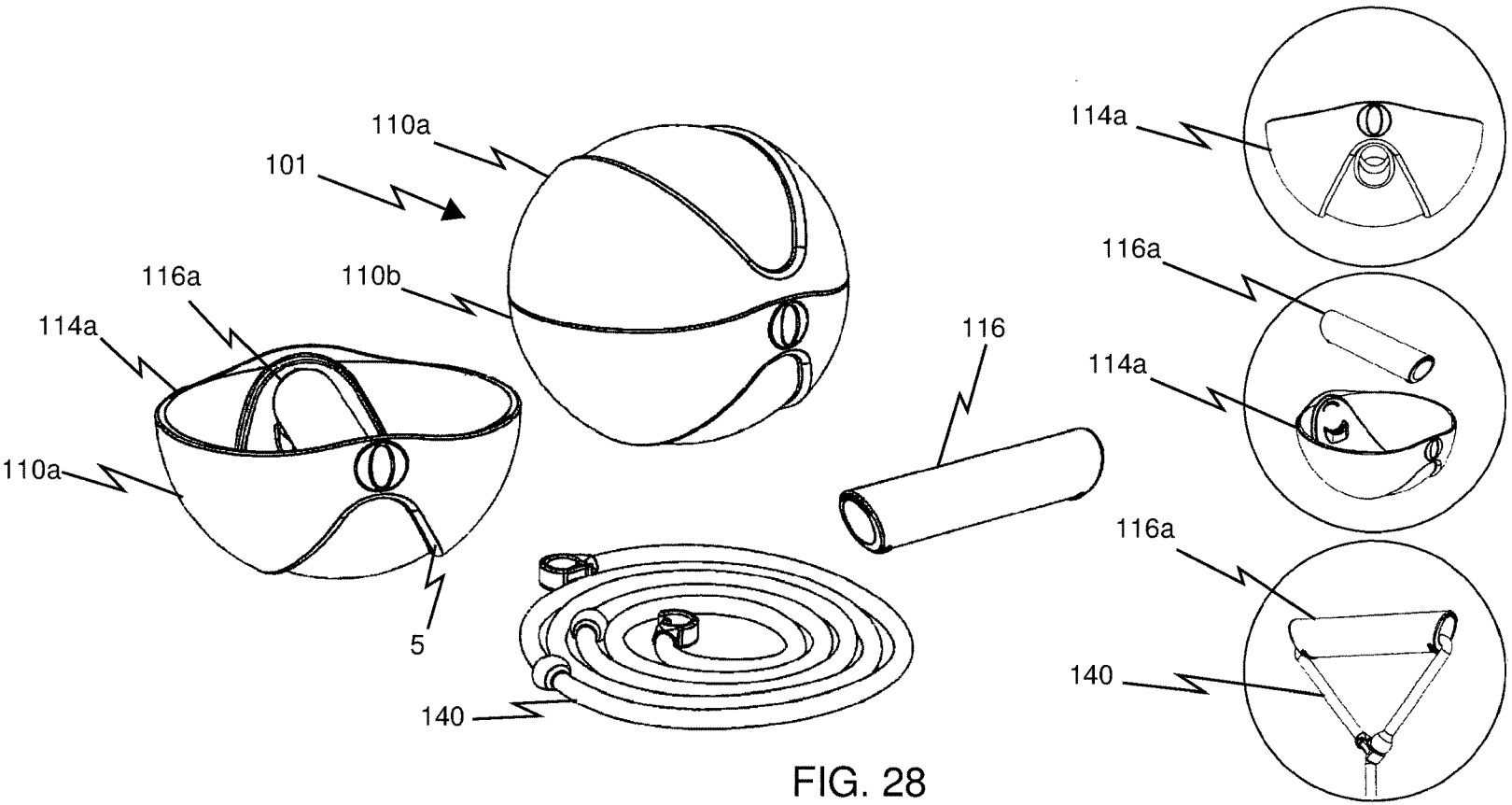
Figure 29:
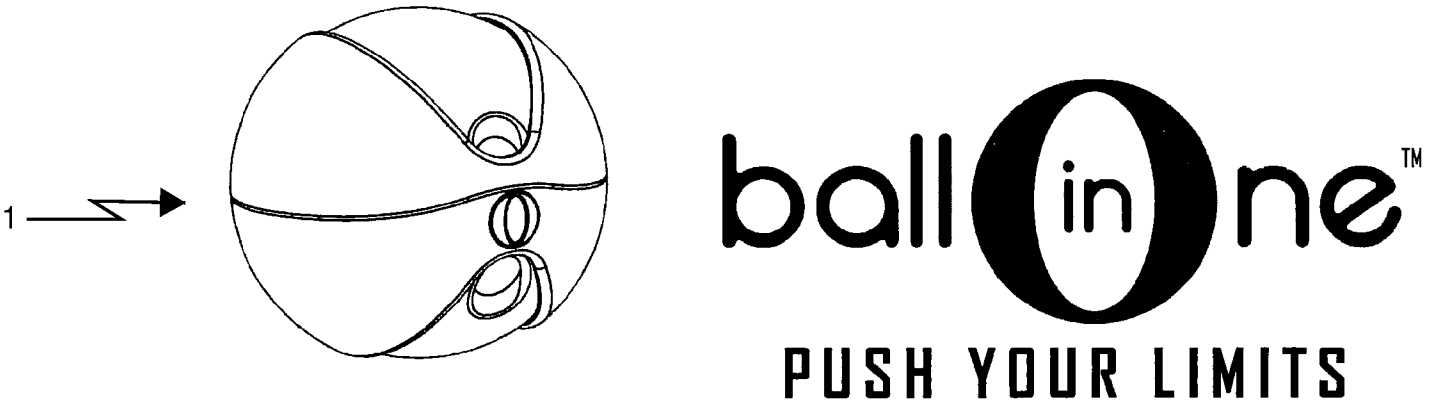

In FIGS. 16, 17 and 24 the handle elements 12*a*, 12*b* have been separated from the housings 14*a*, 14*b* and a resistance tube 40 is threaded through the lumen of each handle bar 16*a*, 16*b*. Clips 41 are provided at each end of the tube 40 so that it can be clipped to each handle (see FIG. 24). By standing in the middle of the tube a user can now pull on both handles as shown.

FIGS. 18 to 20 and 28 show an alternative embodiment, being a two-piece version in which a handle bar 116*a* fits directly into a one-piece housing body 114*a* (i.e. the housing part and base part are formed integrally and there is no separate seat). Similarly to that described above, the two parts of the apparatus may be profiled in various different ways, and can be releasably engaged with one another in various different ways, such as by using clips, male/female parts, and/or screw threads and so on. The ridge profile 105 is present in this embodiment.

Figure 30:
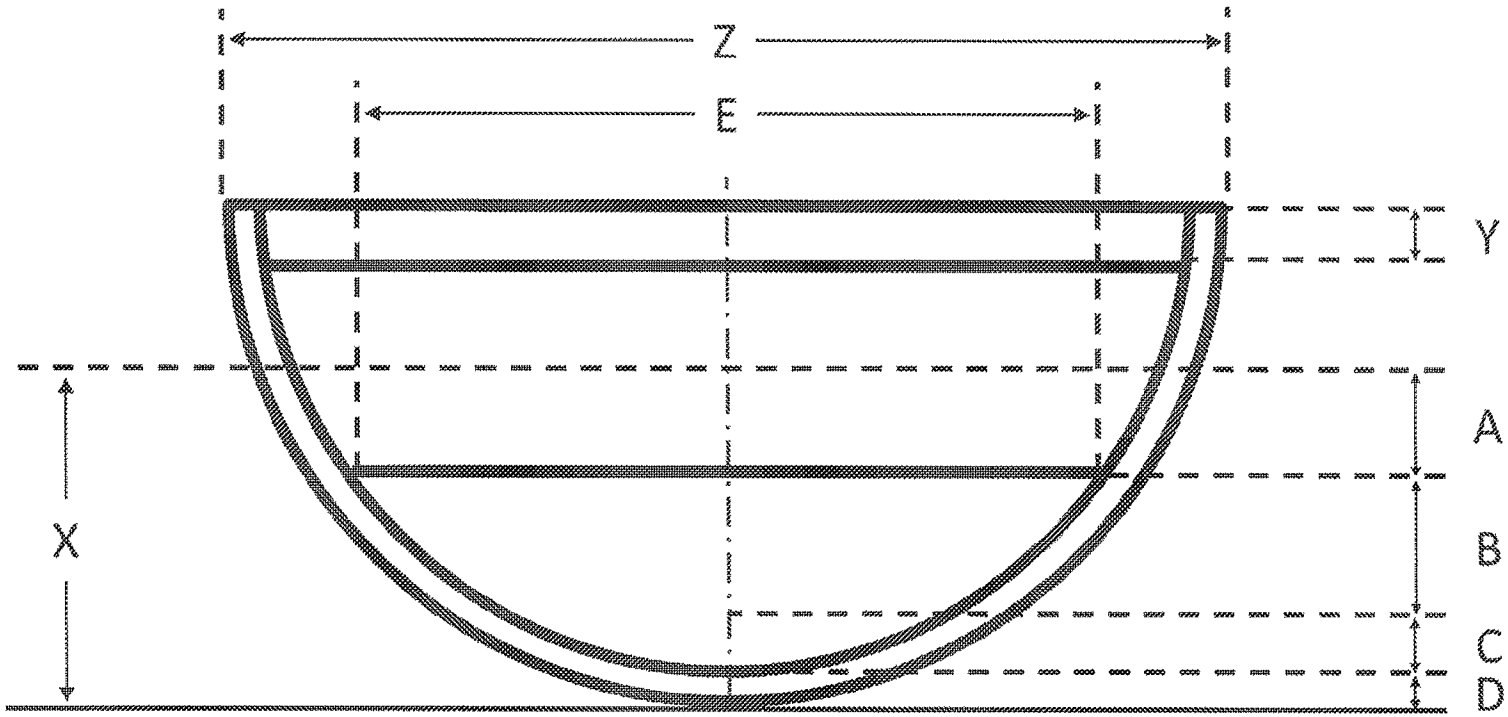
FIG. 30 illustrates a principle of some embodiments of the present invention in which a handle bar is sunken in the hemisphere.

With reference to FIG. 30—given the intended mobile design—it is noted that the handle bar is located within its respective hemisphere (to a value of Y) i.e. it does not project above the open side and is positioned below the open edge by a distance Y. It is also noted that in this embodiment the handle bar extends across the hemisphere and is connected on both sides thereof.

The height at which the handle bar is in relation to the contact surface (X) is paramount; directly stipulating the level of instability. In turn, this height—to an extent—also defines the overall diameter of the complete sphere (Z). Value X is defined as follows;

Minimum Value=Handle Radius (*A*)+Grasping Hand (*B*)+Clearance (*C*)+Material Thickness (*D*)

If, when X is at minimum height, value 'E' does not match or exceed a value defined by anthropometric data, the minimum height will ultimately be defined by value 'E'.

Maximum Value=Desired maximum external diameter of sphere (Z).

Optimum Value=Between the maximum and minimum.

Whilst at present it is foreseen that the optimum—and therefore final—value of X will be defined by its minimum value, as so not to provide excessive instability, this will ultimately be determined through product testing.

Figure 31:
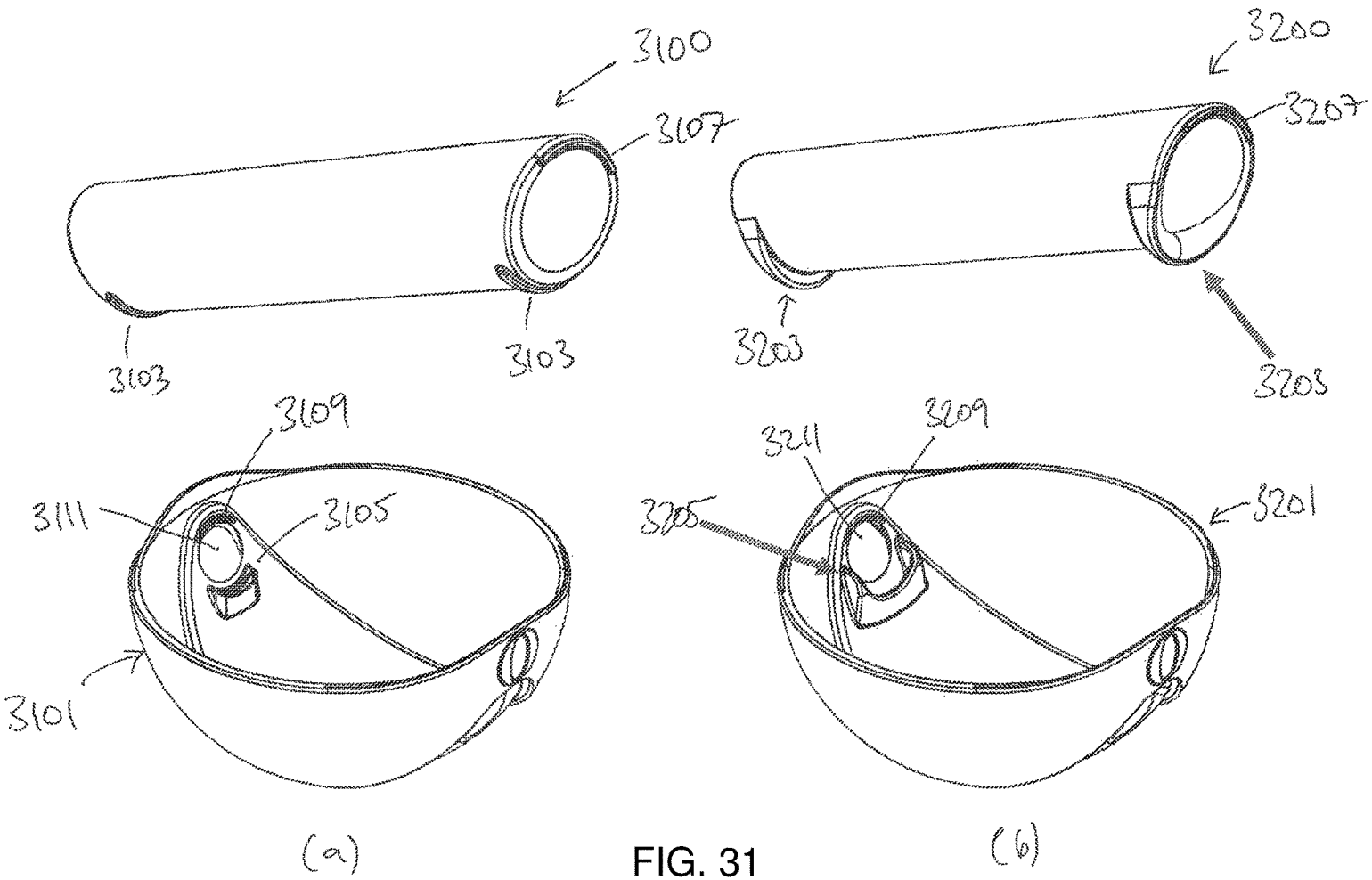
FIGS. 31*a-b* are schematic representations of a portions of an exercise apparatus according to an example.

FIGS. 31*a-b* are schematic representations of portions of an exercise apparatus according to an example. A handle bar 3100 is depicted in FIG. 31*a* which is releasably connectable to a portion 3101. Rims 3103 of bar 3100 are arranged to engage with correspondingly profiled recesses in saddles 3105 (one of which is visible in FIG. 31*a*). A male portion 3107 on bar 3100 is arranged to releasably engage with a correspondingly profiled recess 3109 of portion 3101 above an aperture 3111 in portion 3101 (only one of each of which is visible in the figure).

FIG. 31*b* shows an alternative in which handle bar 3200 is releasably connectable to a portion 3201. Rims 3203 of bar 3200 are arranged to engage with correspondingly openings in saddle portions 3205 (one of which is visible in FIG. 31*b*). The rims 3203 are more pronounced than those of FIG. 31*a*, and accordingly the saddle portions 3205 are larger so as to accommodate the rims. A male portion 3207 on bar 3200 is arranged to releasably engage with a correspondingly profiled recess 3209 of portion 3201 above an aperture 3211 in portion 3201 (only one of each of which is visible in the figure).

Although illustrative embodiments of the invention have been disclosed in detail herein, with reference to the accompanying drawings, it is understood that the invention is not limited to the precise embodiments shown and that various changes and modifications can be effected therein by one skilled in the art without departing from the scope of the invention as defined by the appended claims and their equivalents.

The invention claimed is:

1. An exercise apparatus, comprising:

a pair of handle elements, each of said handle elements including a manually grippable bar and a base portion, said base portion having a substantially spherical contact surface; and a pair of housing elements, each of said housing elements being substantially hemispherical and having a substantially central window formed therein;

each of said handle elements being releasably locatable within a respective one of said housing elements to form a substantially hemispherical handle body in which said contact surface of said handle element is located within said window of said housing element and provides a contact point about which said handle body is rotatable when said contact point is contacting a support surface.

2. The exercise apparatus according to claim 1, wherein said manually grippable bars include attachments to allow a resistance band to be connected between them.

3. The exercise apparatus according to claim 2, wherein said manually grippable bars are apertured to allow an end of the resistance band to be looped through.

4. The exercise apparatus according to claim 2, wherein said handle bodies are configured to be releasably joined together to form a substantially spherical housing, and said substantially spherical housing is configured to contain the resistance band therein.

5. The exercise apparatus according to claim 1, wherein said substantially hemispherical handle body has an upper edge, and said manually grippable bar is positioned below said upper edge.

6. An exercise apparatus, comprising:

a pair of handle elements, each of said handle elements including a manually grippable bar and a base portion, said base portion having a substantially spherical contact surface;

a pair of housing elements, each of said housing elements being substantially hemispherical and having a substantially central window formed therein;

each of said handle elements being releasably locatable within a respective one of said housing elements to form a substantially hemispherical handle body;

said contact surface of said handle element being located within said window of said housing element and providing a contact point about which said handle body is rotatable when said contact point is contacting a support surface; and said handle bodies being configured to be releasably joined together to form a substantially spherical housing.

7. The exercise apparatus according to claim 6, which further comprises an integrated clip configuration, for releasably joining said handle bodies together.

8. An exercise apparatus, comprising:

a pair of handle elements, each of said handle elements including a manually grippable bar and a base portion, said base portion having a substantially spherical contact surface;

a pair of housing elements, each of said housing elements being substantially hemispherical and having a substantially central window formed therein, said windows each having a respective periphery;

each of said handle elements being releasably locatable within a respective one of said housing elements to form a substantially hemispherical handle body;

said contact surface of said handle element being located within said window of said housing element and providing a contact point about which said handle body is rotatable when said contact point is contacting a support surface;

said windows of said housing elements each forming a respective ridge profile inhibiting over-tilting of a respective one of said handle bodies;

said ridge profile being provided by an intersection between said respective periphery of said respective window and said respective contact surface being recessed relative to said respective window.

9. The exercise apparatus according to claim 8, wherein said manually grippable bars each define a respective roll axis, and said ridge profiles each inhibit said over-tilting of said respective one of said handle bodies in either direction of rotation about said roll axis of a respective one of said manually grippable bars.

10. The exercise apparatus according to claim 9, wherein said ridge profiles each inhibit tilting of said respective one of said handle bodies beyond approximately 30 degrees of rotation in either direction about said roll axis of a respective one of said manually grippable bars, from an untilted position of a respective one of said handle bodies.

11. An exercise apparatus, comprising:

a pair of substantially hemispherical handle bodies;

each of said handle bodies including a manually grippable bar;

each of said handle bodies having a substantially central window formed therein;

each of said handle bodies having a substantially spherical contact surface located in a respective one of said windows and providing a respective contact point about which a respective one of said handle bodies is rotatable when said respective contact point is contacting a support surface; and each of said handle bodies has a respective ridge profile for preventing over tilting in a direction of rotation about a respective one of said contact points.

12. The exercise apparatus according to claim 11, wherein said manually grippable bars each have a respective roll axis, and said ridge profiles each inhibit said over-tilting of said respective one of said handle bodies in either direction of rotation about a respective one of said the roll axes.

13. The exercise apparatus according to claim 12, wherein said ridge profiles each inhibit tilting of said respective one of said handle bodies beyond approximately 30 degrees of rotation in either direction about said roll axis of a respective one of said manually grippable bars, from an untilted position of a respective one of said handle bodies.

14. The exercise apparatus according to claim 11, wherein said handle bodies have opposed inner surfaces, and said manually grippable bars each extend diametrically between said opposed inner surfaces of a respective one of said handle bodies.

15. The exercise apparatus according to claim 11, wherein said manually grippable bars are removable from said handle bodies, and fasteners allow a resistance band to be connected between said manually grippable bars after removal.

16. The exercise apparatus according to claim 15, wherein said manually grippable bars are apertured to allow an end of the resistance band to be looped through.

17. The exercise apparatus according to claim 15, wherein said handle bodies are configured to be releasably joined together to form a substantially spherical housing, and said substantially spherical housing is configured to contain the resistance band.

18. The exercise apparatus according to claim 11, wherein said windows are each formed integrally with a respective one of said handle bodies.

19. The exercise apparatus according to claim 11, wherein each of said handle bodies is formed as a respective one-piece structure.

20. An exercise apparatus, comprising:

a pair of substantially hemispherical handle bodies;

each of said handle bodies including a manually grippable bar;

each of said handle bodies having a substantially central window formed therein;

each of said handle bodies having a substantially spherical contact surface located in a respective one of said windows and providing a respective contact point about which a respective one of said handle bodies is rotatable when said respective contact point is contacting a support surface;

each of said handle bodies having a respective ridge profile for preventing over-tilting in a direction of rotation about a respective one of said contact points; and said handle bodies being configured to be releasably joined together to form a substantially spherical housing.

21. An exercise apparatus, comprising:

a pair of substantially hemispherical handle bodies;

each of said handle bodies including a manually grippable bar;

each of said handle bodies having a substantially central window formed therein;

each of said handle bodies having a substantially spherical contact surface located in a respective one of said windows and providing a respective contact point about which a respective one of said handle bodies is rotatable when said respective contact point is contacting a support surface;

each of said handle bodies having a respective ridge profile for preventing over-tilting in a direction of rotation about a respective one of said contact points;

an integrated clip configuration; and said handle bodies being configured to be releasably joined together by said integrated clip configuration.

22. An exercise apparatus, comprising:

a pair of handle elements, each of said handle elements including a base portion having a substantially spherical contact surface and a manually grippable bar releasably connectable to said base portion; and a pair of housing elements, each of said housing elements being substantially hemispherical and having a substantially central window formed therein;

each of said handle elements configured to be releasably located within a respective one of said housing elements to form a respective substantially hemispherical handle body in which said contact surface of said handle element is located within said window of said housing element and provides a contact point about which said handle body is rotatable when said contact point is contacting a support surface.

23. The exercise apparatus according to claim 22, wherein said manually grippable bars are apertured to allow an end of a resistance band to be looped through.

24. An exercise apparatus, comprising:

a push-up shell including a handle element and a housing element;

said housing element being generally hemispherical and having a periphery defining a housing periphery plane;

said handle element including a manually grippable bar being sunken relative to said housing periphery plane;

said handle element having a substantially spherical contact surface about which said handle element is rotatable when said contact surface is contacting a support surface;

said housing element having a window formed therein; and said handle element including a base fitting into said window to provide said contact surface.

25. An exercise apparatus, comprising:

a push-up shell including a handle element and a housing element;

said housing element being generally hemispherical and having a periphery defining a housing periphery plane;

said handle element including a manually grippable bar being sunken relative to said housing periphery plane;

said handle element having a substantially spherical contact surface about which said handle element is rotatable when said contact surface is contacting a support surface said housing element having a window formed therein;

said handle element including a base fitting into said window to provide said contact surface; and said base of said handle element being recessed relative to said window to provide a ridge profile at an intersection of said base and said window.

* * * * *